US008100742B2

(12) United States Patent
Masuda

(10) Patent No.: US 8,100,742 B2
(45) Date of Patent: Jan. 24, 2012

(54) GRINDING METHOD FOR WAFER HAVING CRYSTAL ORIENTATION

(75) Inventor: Takatoshi Masuda, Ota-Ku (JP)

(73) Assignee: Disco Corporation, Tokyo (JP)

( * ) Notice: Subject to any disclaimer, the term of this patent is extended or adjusted under 35 U.S.C. 154(b) by 546 days.

(21) Appl. No.: 12/408,469

(22) Filed: Mar. 20, 2009

(65) Prior Publication Data

US 2009/0247056 A1 Oct. 1, 2009

(30) Foreign Application Priority Data

Mar. 31, 2008 (JP) ..... 2008-090015

(51) Int. Cl.
*B24B 1/00* (2006.01)

(52) U.S. Cl. ..... 451/54; 451/57; 451/58; 451/65

(58) Field of Classification Search ..... 451/54, 451/57, 58, 41, 63, 65, 285, 287, 290
See application file for complete search history.

(56) References Cited

U.S. PATENT DOCUMENTS 7,462,094 B2 * 12/2008 Yoshida et al. ..... 451/41
7,500,902 B2 * 3/2009 Nomiya ..... 451/8
7,559,826 B2 * 7/2009 Sekiya ..... 451/41
7,758,402 B2 * 7/2010 Yoshida et al. ..... 451/11
2003/0181150 A1 * 9/2003 Arai et al. ..... 451/285

FOREIGN PATENT DOCUMENTS

JP A 2000-354962 12/2000
JP A 2005-28550 2/2005

* cited by examiner

*Primary Examiner* — George Nguyen
(74) *Attorney, Agent, or Firm* — Greer, Burns & Crain, Ltd.

(57) ABSTRACT

A grinding method for a wafer having a mark indicating the crystal orientation. The grinding method includes a first grinding step for grinding the upper surface of the wafer by rotating a chuck table holding the wafer thereon, rotating a grinding ring, positioning the grinding ring so that the grinding ring is passed through the center of the wafer, and feeding the grinding ring in a direction perpendicular to the chuck table; a wafer positioning step for positioning the upper surface of an outer circumferential portion of the wafer directly below the locus of rotation of the grinding ring; and a second grinding step for grinding the upper surface of the wafer by first stopping the rotation of the chuck table so that the mark indicating the crystal orientation of the wafer held on the chuck table is pointed in a predetermined direction, next feeding the grinding ring in the direction perpendicular to the chuck table, and next relatively moving the chuck table and the grinding ring in parallel.

1 Claim, 9 Drawing Sheets

GRINDING METHOD FOR WAFER HAVING CRYSTAL ORIENTATION

BACKGROUND OF THE INVENTION

1. Field of the Invention

The present invention relates to a wafer grinding method for grinding a wafer having crystal orientation.

2. Description of the Related Art

In a semiconductor device fabrication process, a plurality of crossing division lines called streets are formed on the front side of a substantially disk-shaped semiconductor wafer to thereby partition a plurality of rectangular regions where devices such as ICs and LSIs are respectively formed. The semiconductor wafer having many devices as mentioned above is divided along these streets to thereby obtain individual semiconductor chips. Also in the case of a wafer composed of a substrate of lithium tantalate, for example, and a plurality of piezoelectric elements provided in the substrate, the wafer is cut along predetermined streets to obtain individual chips, which are widely used in electrical equipment.

To reduce the size and weight of each chip, the back side of the wafer is usually ground to reduce the thickness of the wafer to a predetermined thickness prior to dividing the wafer along the streets to obtain the individual chips. Further, a so-called early dicing is generally performed as a wafer dividing method such that the wafer is not fully cut into the individual chips by a cutting apparatus, but a groove having a predetermined depth corresponding to the finished thickness of each chip is formed along each street on the front side of the wafer, and the back side of the wafer is next ground until the bottom of each groove is exposed to the back side of the wafer.

It is known that a grinding apparatus for grinding the back side of the wafer includes a chuck table for holding the wafer as a workpiece and grinding means having an annular grinding wheel for grinding the upper surface (back side) of the wafer held on the chuck table, wherein the back side of the wafer is ground by rotating the chuck table, rotating the grinding wheel, and feeding the grinding wheel so that the lower end surface or grinding surface of the grinding wheel is passed through the center of the wafer held on the chuck table (see Japanese Patent Laid-open No. 2000-354962, for example).

According to the grinding method described in Japanese Patent Laid-open No. 2000-354962 mentioned above, the wafer can be efficiently ground to obtain a predetermined thickness. However, as the result of measurement of the die strength of each chip obtained by dividing the wafer after such back grinding, it has been found that some chips having a remarkably low die strength are quantitatively present. More specifically, in the case that the wafer is ground by the grinding method described in Japanese Patent Laid-open No. 2000-354962, a saw mark is formed on the ground surface of the wafer so as to extend radially from the center of the wafer to the outer circumference thereof. In relation to the crystal orientation of the wafer, some chips are quantitatively present in a region where the saw mark extends in an easily breakable direction, so that some chips having a remarkably low die strength are quantitatively generated. It is known that the region where the chips having a low die strength are quantitatively generated is a region where a mark for indicating the crystal orientation of the wafer is in a predetermined relation to the saw mark (in the case of a silicon wafer, the saw mark extends at 45° with respect to the mark indicating the crystal orientation).

To solve the above problem, there has been proposed a wafer grinding method including a first grinding step and a second grinding step. The first grinding step is performed by rotating a chuck table holding a wafer, rotating a grinding wheel, and feeding the grinding wheel so that the lower end surface of the grinding wheel is passed through the center of the wafer, thereby grinding the upper surface of the wafer held on the chuck table. After performing the first grinding step, the second grinding step is performed by moving the chuck table holding the wafer to a position spaced sideways from the grinding wheel to point the mark indicating the crystal orientation in a predetermined direction, next feeding the grinding wheel by a predetermined amount to a grinding position, and next relatively moving in parallel the chuck table holding the wafer and the grinding wheel being rotated at the grinding position, thereby grinding the upper surface of the wafer from the outer circumference of the wafer in a predetermined direction (see Japanese Patent Laid-open No. 2005-28550, for example).

In the wafer grinding method disclosed in Japanese Patent Laid-open No. 2005-28550 mentioned above, the outer circumferential surface of the wafer comes into impactive contact with the grinding wheel in the second grinding step, causing a possibility of chipping of the wafer.

SUMMARY OF THE INVENTION

It is therefore an object of the present invention to provide a wafer grinding method which can grind a wafer without reducing a grinding efficiency, prevent the generation of a chip having a low die strength, and prevent the chipping of the wafer.

In accordance with an aspect of the present invention, there is provided a wafer grinding method for grinding a wafer having a mark for indicating crystal orientation, the wafer grinding method including a first grinding step for grinding the upper surface of the wafer by rotating a chuck table holding the wafer thereon, rotating a grinding ring, positioning the grinding ring so that the grinding ring is passed through the center of the wafer, and feeding the grinding ring in a direction perpendicular to a holding surface of the chuck table on which the wafer is held; a wafer positioning step for positioning the upper surface of an outer circumferential portion of the wafer directly below the locus of rotation of the grinding ring after the first grinding step by relatively moving the chuck table and the grinding ring in parallel in a first direction during rotation of the chuck table and the grinding ring; and a second grinding step for grinding the upper surface of the wafer ground by the first grinding step by first stopping the rotation of the chuck table so that the mark indicating the crystal orientation of the wafer held on the chuck table is pointed in a predetermined direction, next feeding the grinding ring being rotated by a predetermined amount in the direction perpendicular to the holding surface of the chuck table, and next relatively moving the chuck table and the grinding ring in parallel in a second direction opposite to the first direction.

According to the wafer grinding method of the present invention, the back side of the wafer is ground in the first grinding step in such a manner that the chuck table holding the wafer is rotated and the grinding ring is also rotated at a position where the grinding ring is passed through the center of the wafer. By the first grinding step, the thickness of the wafer is reduced to a predetermined thickness, so that the wafer can be ground without reducing a grinding efficiency. Thereafter, the back side of the wafer is further ground in the second grinding step in such a manner that a saw mark is not formed in a direction where the die strength of a chip is prone to be reduced in relation to the mark indicating the crystal orientation of the wafer. Accordingly, a reduction in die strength of the chip obtained by dividing the wafer can be prevented. Further, in the second grinding step, the upper surface (back side) of the outer circumferential portion of the wafer is positioned directly below the locus of rotation of the grinding ring and the grinding ring is lowered to partially grind the back side of the wafer. Thereafter, the chuck table and the grinding ring are relatively moved in parallel to thereby entirely grind the back side of the wafer. Thus, the grinding ring is kept in contact with the wafer during the second grinding step, so that the grinding operation can be smoothly performed without giving a shock to the wafer.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
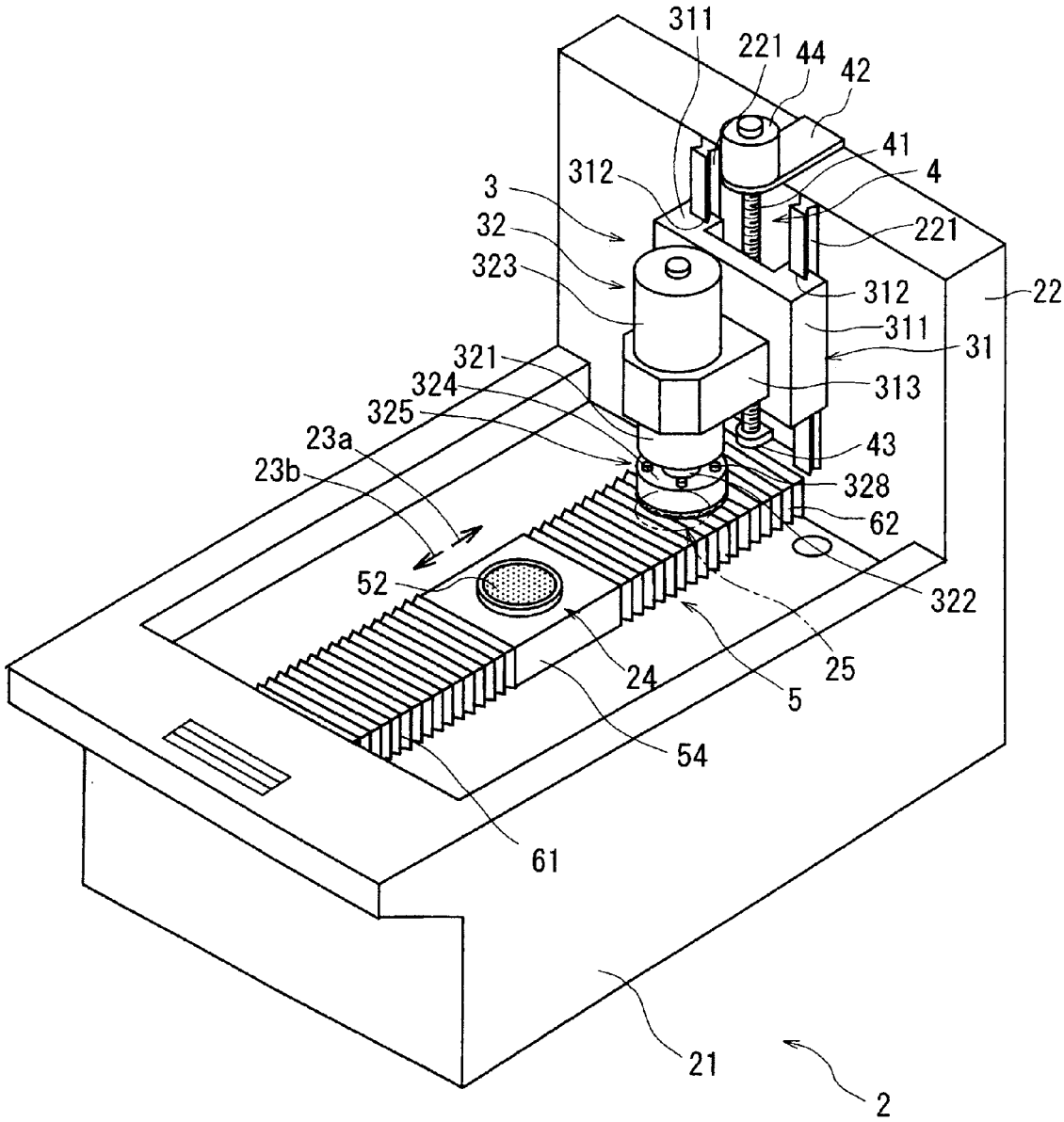
FIG. 1 is a perspective view of a grinding apparatus for performing the wafer grinding method according to the present invention.

A preferred embodiment of the wafer grinding method according to the present invention will now be described in detail with reference to the attached drawings. FIG. 1 shows a perspective view of a grinding apparatus for carrying out the grinding method according to the present invention. The grinding apparatus shown in FIG. 1 includes an apparatus housing 2 generally designated. The apparatus housing 2 has a main portion 21 having a substantially rectangular parallelepiped shape extending in a horizontal direction and a vertical wall 22 provided at the rear end of the main portion 21 (right upper end as viewed in FIG. 1) so as to extend in a substantially vertical direction. A pair of parallel guide rails 221 are provided on the front surface of the vertical wall 22 so as to extend in the vertical direction. A grinding unit 3 as grinding means is mounted on the guide rails 221 so as to be movable in the vertical direction.

The grinding unit 3 includes a moving base 31 and a spindle unit 32 mounted on the moving base 31. The moving base 31 is provided with a pair of leg portions 311. These pair of leg portions 311 are respectively formed with a pair of guided grooves 312 respectively slidably engaged with the pair of guide rails 221. A frontward projecting support portion 313 is provided on the front surface of the moving base 31 slidably mounted on the pair of guide rails 221 provided on the vertical wall 22. The spindle unit 32 is supported to the support portion 313.

Figure 2:
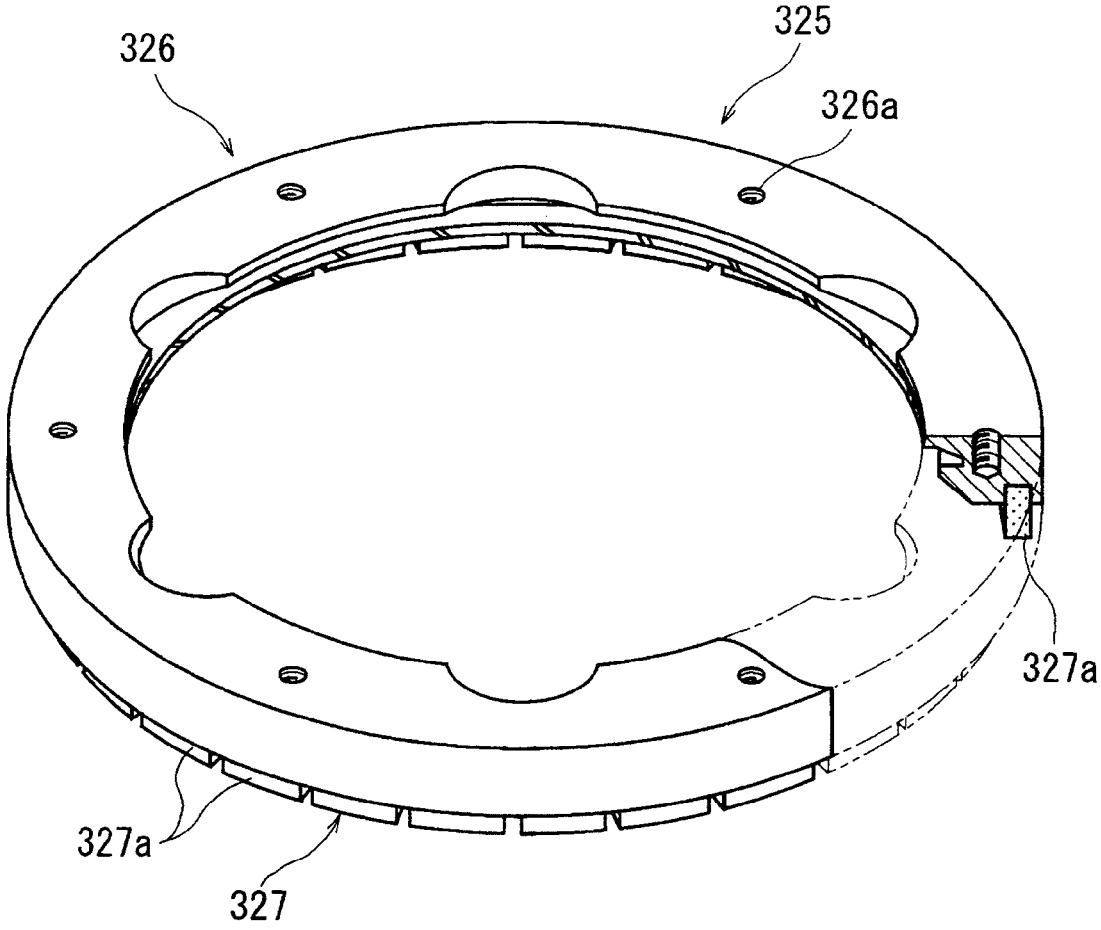
FIG. 2 is a perspective view of a grinding tool constituting a grinding unit in the grinding apparatus shown in FIG. 1.

The spindle unit 32 includes a spindle housing 321 mounted on the support portion 313, a rotating spindle 322 rotatably supported to the spindle housing 321, and a servo motor 323 as driving means for rotationally driving the rotating spindle 322. A lower end portion of the rotating spindle 322 projects downwardly from the lower end surface of the spindle housing 321. A disk-shaped tool mounting member 324 is provided on the lower end of the rotating spindle 322. The tool mounting member 324 is formed with a plurality of bolt insertion holes (not shown) spaced in the circumferential direction. A grinding tool 325 is mounted on the lower surface of the tool mounting member 324. As shown in FIG. 2, the grinding tool 325 is composed of an annular support member 326 and a grinding ring 327 mounted on the lower surface of the support member 326. The support member 326 is formed with a plurality of blind tapped holes 326*a* spaced in the circumferential direction and extending downwardly from the upper surface of the support member 326. The grinding ring 327 is composed of a plurality of abrasive members 327*a* fixed to the lower surface of the support member 326 and arranged at regular intervals in the circumferential direction of the support member 326. The outer diameter of the grinding ring 327 is preferably set twice or more the outer diameter of a wafer as a workpiece to be hereinafter described. The grinding tool 325 is mounted to the tool mounting member 324 by aligning the grinding tool 325 to the tool mounting member 324 on the lower surface thereof, inserting a plurality of fastening bolts 328 through the bolt insertion holes of the tool mounting member 324, and screwing the fastening bolts 328 into the blind tapped holes 326*a* of the support member 326.

Referring back to FIG. 1, the grinding apparatus shown includes a grinding unit feeding mechanism 4 for moving the grinding unit 3 along the pair of guide rails 221 in the vertical direction (in the direction perpendicular to a holding surface of a chuck table to be hereinafter described). The grinding unit feeding mechanism 4 includes an externally threaded rod 41 provided on the front side of the vertical wall 22 so as to extend in the substantially vertical direction. The externally threaded rod 41 is rotatably supported at its upper and lower ends to a pair of upper and lower bearing members 42 and 43 mounted on the vertical wall 22. A pulse motor 44 as a drive source for rotationally driving the externally threaded rod 41 is provided on the upper bearing member 42, and an output shaft of the pulse motor 44 is connected to the externally threaded rod 41 so as to transmit a drive force thereto. A connecting portion (not shown) for operatively connecting the moving base 31 to the externally threaded rod 41 is formed on the rear surface of the moving base 31 so as to project rearwardly from a laterally central portion of the moving base 31. This connecting portion is formed with an internally threaded through hole extending in the vertical direction, and the externally threaded rod 41 is threadedly engaged with this internally threaded through hole of the connecting portion of the moving base 31. Accordingly, when the pulse motor 44 is operated in a forward direction, the moving base 31 or the grinding unit 3 is lowered or advanced (fed forward), whereas when the pulse motor 44 is operated in a reverse direction, the moving base 31 or the grinding unit 3 is raised or retracted.

Figure 3:
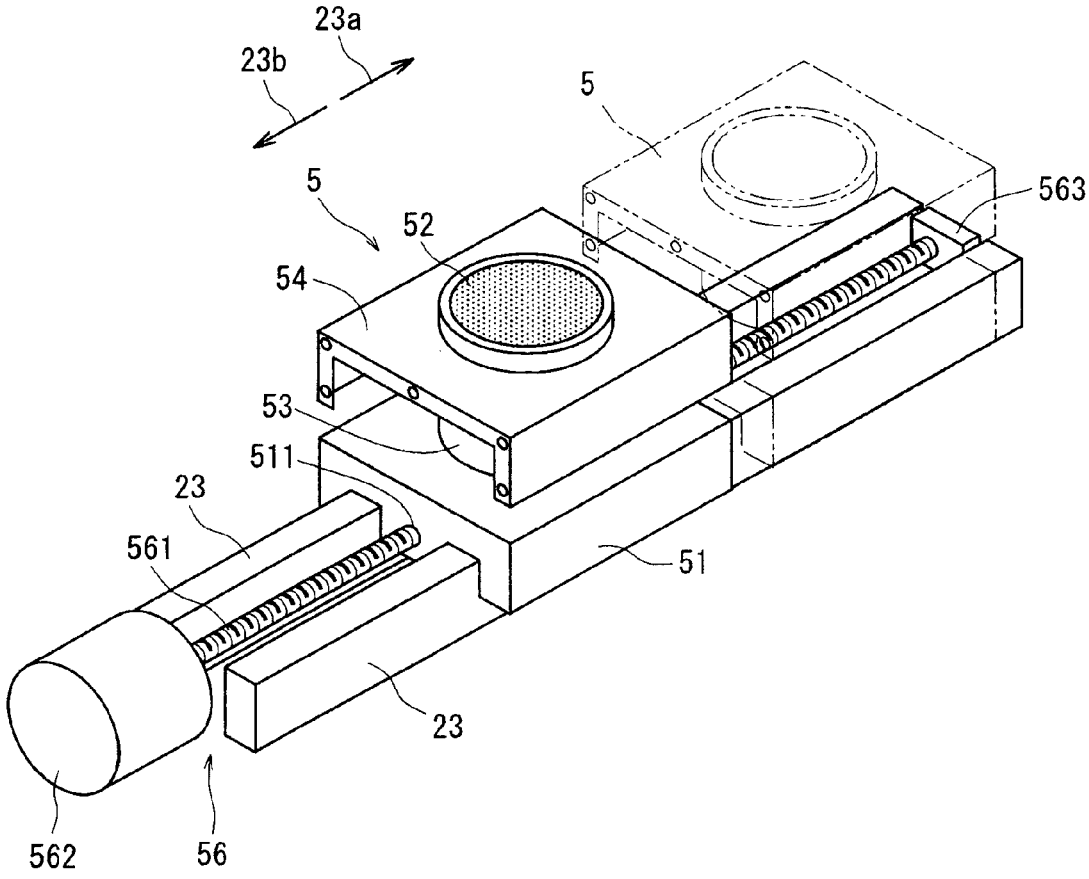
FIG. 3 is a perspective view of a chuck table mechanism and a chuck table moving mechanism in the grinding apparatus shown in FIG. 1.

Referring to FIGS. 1 and 3, a chuck table mechanism 5 is provided on the main portion 21 of the housing 2. The chuck table mechanism 5 includes a supporting base 51 and a chuck table 52 provided on the supporting base 51. The supporting base 51 is slidably mounted on a pair of guide rails 23 extending in a longitudinal direction (in a direction perpendicular to the front surface of the vertical wall 22) so as to be movable in the opposite directions shown by arrows 23*a* and 23*b*. That is, the supporting base 51 is movable between a workpiece setting area 24 shown in FIG. 1 (position shown by a solid line in FIG. 3) and a grinding area 25 (position shown by a phantom line in FIG. 3) where the chuck table 52 is opposed to the grinding surface (lower end surface) of the grinding ring 327 of the grinding tool 325 constituting the spindle unit 32. The chuck table 52 is formed of a suitable porous material such as porous ceramics, and it is connected to suction means (not shown). Accordingly, by making selective communication between the chuck table 52 and the suction means, a wafer (to be hereinafter described) as a workpiece set on the upper surface or holding surface of the chuck table 52 can be held by suction vacuum. Further, the chuck table 52 is rotatably supported to the supporting base 51. That is, a rotating shaft (not shown) is mounted on the lower end of the chuck table 52, and a servo motor 53 as rotationally driving means is connected to this rotating shaft, so that the chuck table 52 is rotated by the servo motor 53. The chuck table mechanism 5 includes a cover member 54 having a hole for insertion of the chuck table 52 and covering the supporting base 51. The cover member 54 is movable with the supporting base 51.

Referring again to FIG. 3, the grinding apparatus shown in FIG. 1 includes a chuck table moving mechanism 56 for moving the chuck table mechanism 5 along the pair of guide rails 23 in the opposite directions shown by the arrows 23*a* and 23*b*. The chuck table moving mechanism 56 includes an externally threaded rod 561 provided between the pair of guide rails 23 so as to extend parallel to these guide rails 23 and a servo motor 562 for rotationally driving the externally threaded rod 561. The externally threaded rod 561 is threadedly engaged with an internally threaded through hole 511 formed in the supporting base 51. The front end of the externally threaded rod 561 (right upper end as viewed in FIG. 3) is rotatably supported to a bearing member 563 connected to the pair of guide rails 23. A drive shaft of the servo motor 562 is connected to the base end of the externally threaded rod 561 (left lower end as viewed in FIG. 3) so as to transmit a drive force thereto. Accordingly, when the servo motor 562 is operated in a forward direction, the supporting base 51 or the chuck table mechanism 5 is moved in the direction shown by the arrow 23*a*, whereas when the servo motor 562 is operated in a reverse direction, the supporting base 51 or the chuck table mechanism 5 is moved in the direction shown by the arrow 23*b*.

Referring again to FIG. 1, a pair of bellows means 61 and 62 for covering the guide rails 23, the externally threaded rod 561, and the servo motor 562 are provided on the opposite ends of the supporting base 51 in the opposite directions shown by the arrows 23*a* and 23*b*. Each of the bellows means 61 and 62 has an inverted U-shape, and it is formed of a suitable material such as canvas. The front end of the bellows means 61 is fixed to the front wall of the main portion 21, and the rear end of the bellows means 61 is fixed to the front end surface of the cover member 54 of the chuck table mechanism 5. On the other hand, the front end of the bellows means 62 is fixed to the rear end surface of the cover member 54 of the chuck table mechanism 5, and the rear end of the bellows means 62 is fixed to the front surface of the vertical wall 22 of the housing 2. When the chuck table mechanism 5 is moved in the direction shown by the arrow 23*a*, the bellows means 61 is expanded and the bellows means 62 is contracted, whereas when the chuck table mechanism 5 is moved in the direction shown by the arrow 23*b*, the bellows means 61 is contracted and the bellows means 62 is expanded.

Figure 4:
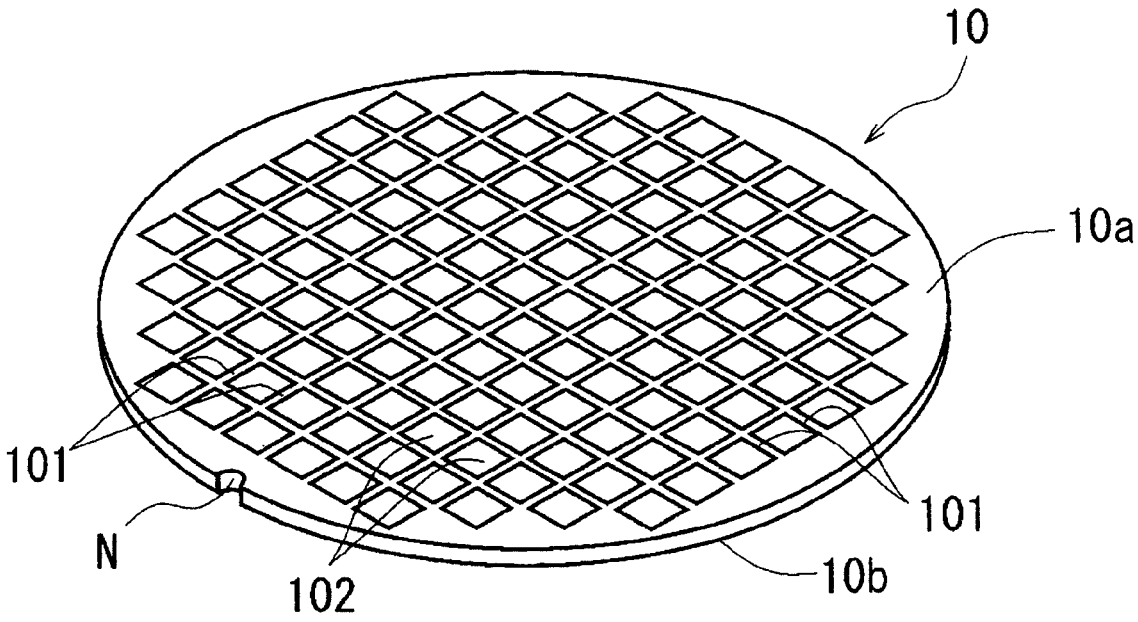
FIG. 4 is a perspective view of a wafer to be ground by the grinding method according to the present invention.
Figure 5A:
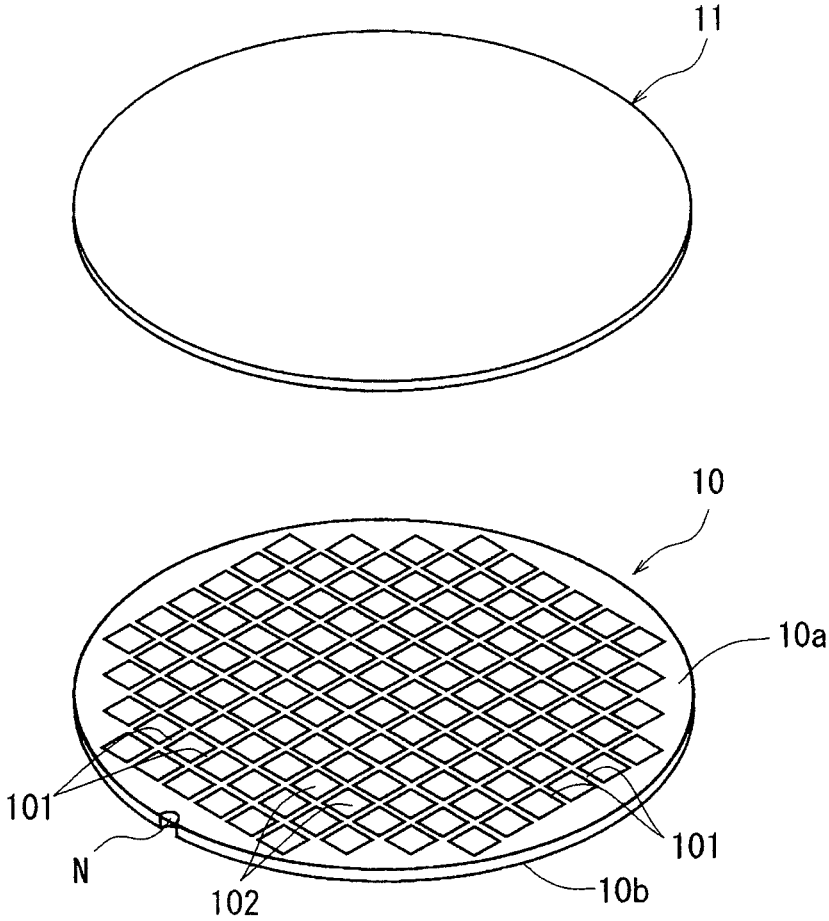
FIGS. 5A and 5B are perspective views for illustrating a protective tape attaching step in the wafer grinding method according to the present invention.
Figure 5B:
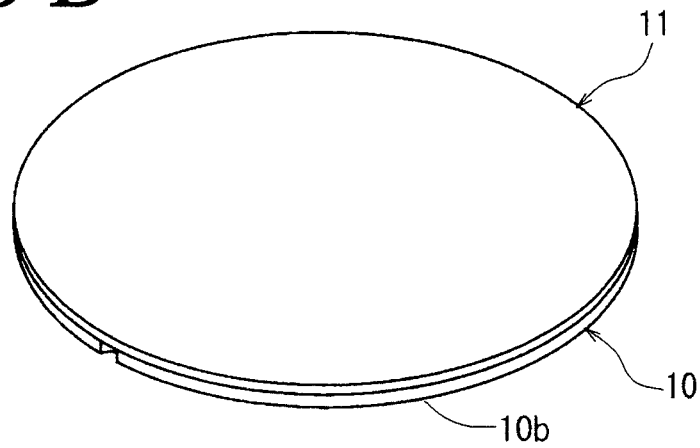

There will now be described a grinding method for grinding a wafer having crystal orientation by using the grinding apparatus mentioned above. FIG. 4 shows a wafer 10 having crystal orientation to be ground by the wafer grinding method according to the present invention. The wafer 10 having crystal orientation shown in FIG. 4 is a silicon substrate. The front side 10*a* of the wafer 10 is partitioned into a plurality of regions by a plurality of crossing streets (division lines) 101, and devices 102 such as ICs and LSIs are respectively formed in these regions. A notch N as a mark for indicating the crystal orientation is formed at a predetermined position on the outer circumference of the wafer 10. As shown in FIGS. 5A and 5B, a protective tape 11 for projecting the devices 102 is attached to the front side 10*a* of the wafer 10 prior to grinding the back side 10*b* of the wafer 10 (protective tape attaching step).

The wafer 10 with the adhesive tape 11 attached to the front side 10*a* is next set on the holding surface of the chuck table 52 positioned in the workpiece setting area 24 in the grinding apparatus shown in FIG. 1 in the condition where the back side 10*b* of the wafer 10 is oriented upward. Thereafter, the wafer 10 set on the holding surface of the chuck table 52 is held thereon by the suction means (not shown).

Figure 6A:
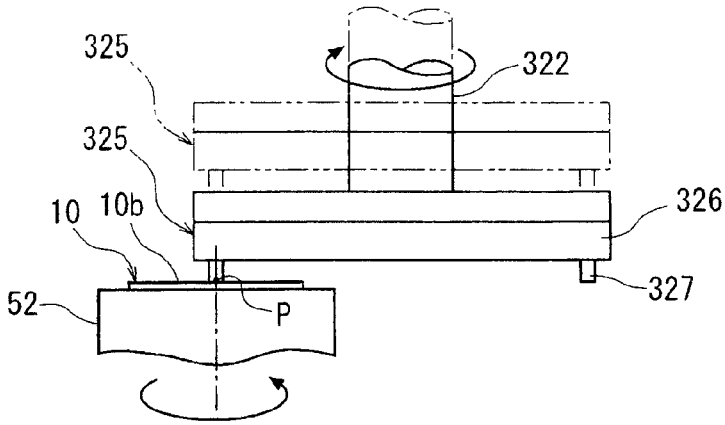
FIGS. 6A to 6C are side and plan views for illustrating a first grinding step in the wafer grinding method according to the present invention.
Figure 6B:
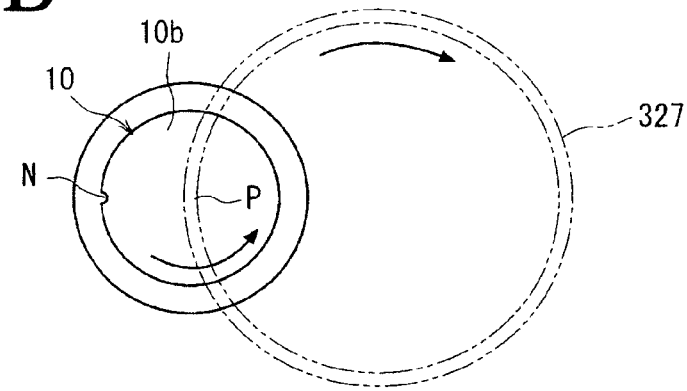
Figure 6C:
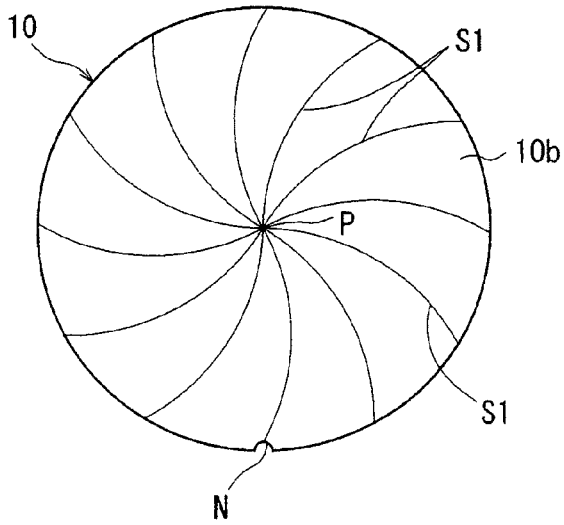

After holding the wafer 10 on the chuck table 52 under suction vacuum as mentioned above, the chuck table moving mechanism 56 (see FIG. 3) is operated to move the chuck table mechanism 5 in the direction shown by the arrow 23*a* until the wafer 10 held on the chuck table 52 reaches the grinding area 25 below the grinding ring 327. In the grinding area 25, the wafer 10 is positioned so that the grinding ring 327 passes through the center P of the wafer 10 as shown in FIGS. 6A and 6B. After positioning the wafer 10 in the grinding area 25 as mentioned above, the servo motor 53 is driven to rotate the chuck table 52 at 300 rpm and the servo motor 323 is driven to rotate the grinding tool 325 at 6000 rpm. Further, the pulse motor 44 of the grinding unit feeding mechanism 4 is driven in the forward direction to lower (feed) the grinding unit 3 from a standby position shown by a phantom line in FIG. 6A until the lower end surface or grinding surface of the grinding ring 327 comes into abutment against the upper surface (back side 10*b*) of the wafer 10 held on the chuck table 52. Thereafter, the grinding tool 325 is further lowered (fed) by a predetermined amount to grind the back side 10*b* of the wafer 10 until a predetermined thickness is obtained (first grinding step). This predetermined thickness is set to a thickness larger than a finished thickness by about 2 μm. As the result of the first grinding step, a saw mark S1 is formed on the upper surface (back side 10*b*) of the wafer 10 so as to radially extend from the center P to the outer circumference of the wafer 10 as shown in FIG. 6C.

Figure 7A:
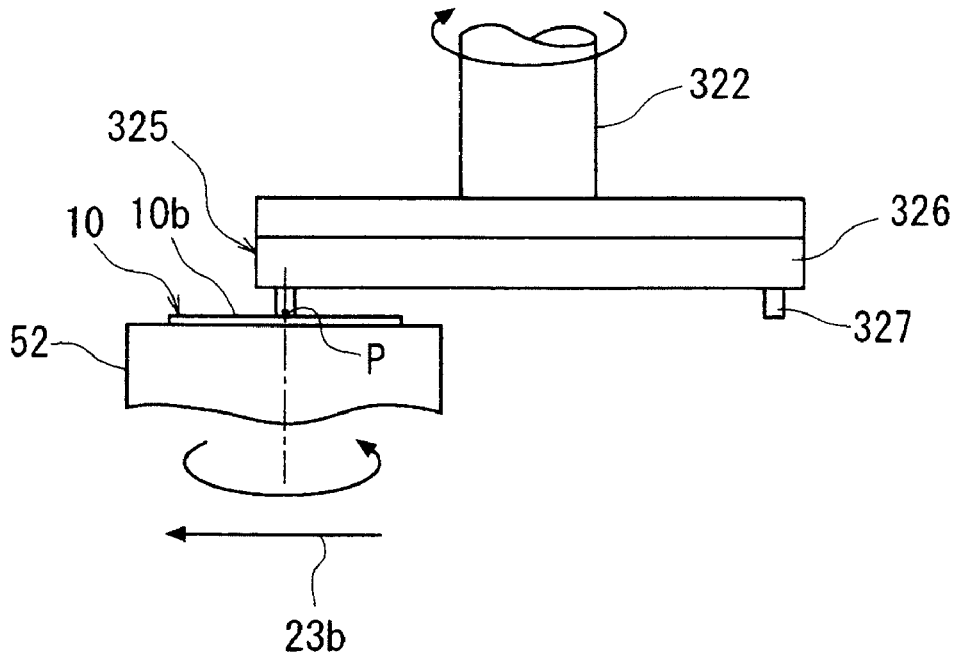
FIGS. 7A and 7B are side views for illustrating a wafer positioning step in the wafer grinding method according to the present invention.
Figure 7B:
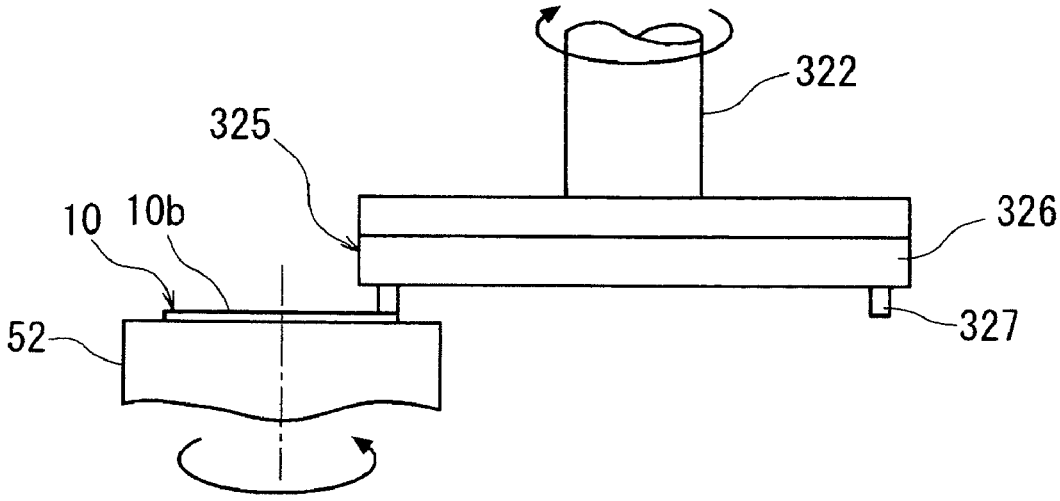

After finishing the first grinding step, the chuck table 52 and the grinding ring 327 are relatively moved in parallel in a first direction in the condition where the chuck table 52 and the grinding ring 327 are both rotated until the upper surface of the outer circumferential portion of the wafer 10 is positioned directly below the locus of rotation of the grinding ring 327 (wafer positioning step). More specifically, the chuck table 52 is moved in the first direction shown by the arrow 23*b* from the position shown in FIG. 7A (the condition after finishing the first grinding step) by reversely driving the servo motor 562 of the chuck table moving mechanism 56. After the upper surface of the outer circumferential portion of the wafer 10 held on the chuck table 52 reaches the position directly below the locus of rotation of the grinding ring 327 as shown in FIG. 7B, the operation of the servo motor 562 of the chuck table moving mechanism 56 is stopped to thereby stop the movement of the chuck table 52.

After finishing the wafer positioning step mentioned above, the rotation of the chuck table 52 is stopped so that the mark indicating the crystal orientation of the wafer 10 held on the chuck table 52 is pointed in a predetermined direction. Thereafter, the grinding ring 327 being rotated is fed by a predetermined amount in the direction perpendicular to the holding surface of the chuck table 52. Thereafter, the chuck table 52 and the grinding ring 327 are relatively moved in parallel in a second direction opposite to the first direction, thereby grinding the upper surface (back side 10*b*) of the wafer 10 ground by the first grinding step (second grinding step). This second grinding step will now be described in more detail with reference to FIGS. 8A to 8C.

Figure 8A:
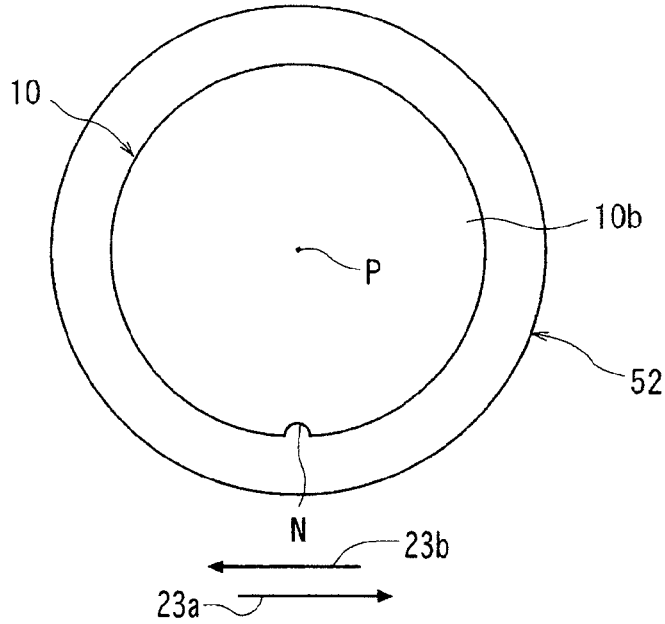
FIGS. 8A to 8C are plan and side views for illustrating a second grinding step in the wafer grinding method according to the present invention.
Figure 8B:
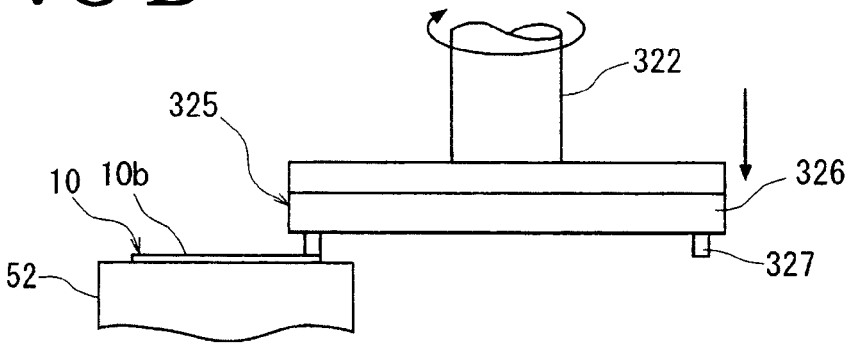
Figure 8C:
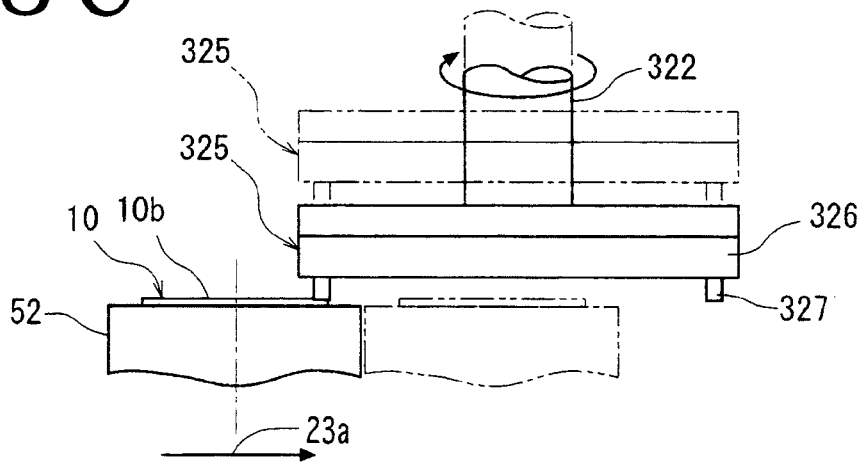

As shown in FIG. 8A, the rotation of the chuck table 52 is stopped so that a line connecting the notch N indicating the crystal orientation of the wafer 10 held on the chuck table 52 and the center P of the wafer 10 becomes normal to the direction of movement of the chuck table 52 shown by the arrows 23*a* and 23*b*. As shown in FIG. 8B, the grinding tool 325 being rotated is lowered (fed) by a predetermined amount (t) to set the grinding ring 327 at a grinding position. Accordingly, as shown by a solid line in FIG. 8C, the upper surface (back side 10*b*) of the outer circumferential portion of the wafer 10 (right end portion of the wafer 10 as viewed in FIG. 8C) is ground by the predetermined amount (t). The predetermined amount (t) or the feed amount of the grinding ring 327 from the upper surface (back side 10*b*) of the wafer 10 is set to 2 μm in this preferred embodiment. Thereafter, in the condition where the grinding ring 327 is maintained at the grinding position, the servo motor 562 of the chuck table moving mechanism 56 is driven in the forward direction to move the chuck table 52 in the second direction shown by the arrow 23*a* at a feed speed of 6 to 10 cm/min, thus feeding the wafer 10 in parallel to the grinding ring 327 to a grinding end position shown by a phantom line in FIG. 8C.

Figure 9:
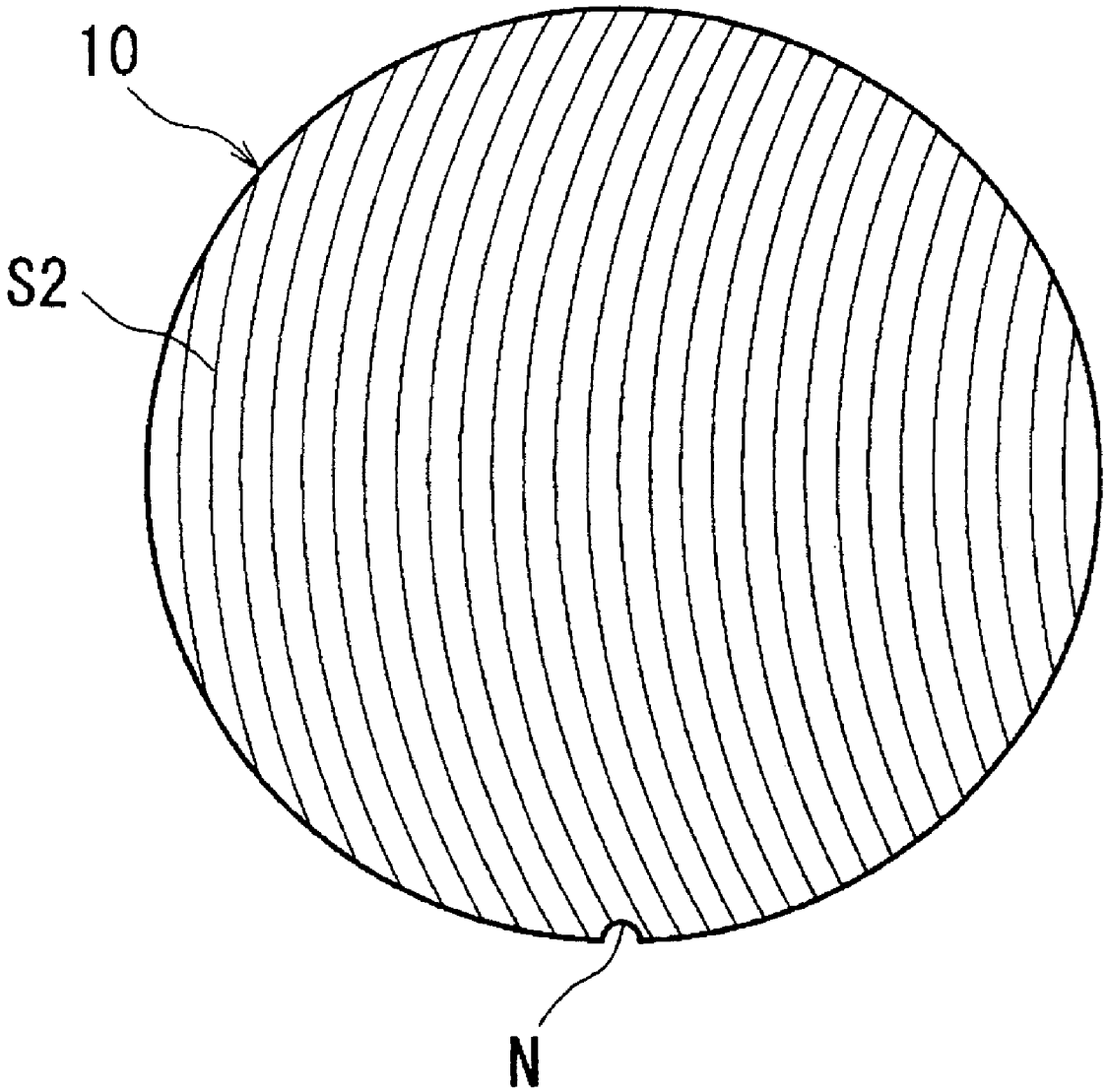
FIG. 9 is a plan view showing the ground surface of the wafer obtained by the second grinding step.

The grinding end position is set to a position where the rear end of the wafer 10 being fed in the direction shown by the arrow 23*a* has just passed through the lower end surface of the grinding ring 327. As a result, the upper surface (back side 10*b*) of the wafer 10 is ground by the grinding ring 327 being rotated. After moving the chuck table mechanism 5 to the grinding end position mentioned above, the grinding tool 325 is raised to the standby position shown by a phantom line in FIG. 8C. As the result of the second grinding step mentioned above, the saw mark S1 formed in the first grinding step is removed and a new saw mark S2 is formed on the upper surface (back side 10*b*) of the wafer 10 as a ground surface so as to extend in a direction substantially normal to a tangential line at the notch N as shown in FIG. 9. That is, no saw mark is formed so as to extend in a direction at 45° with respect to the tangential line at the notch N in a region where a chip having a low die strength is prone to generate (e.g., in a region formed at 45° with respect to the tangential line at the notch N). Preferably, the saw mark S2 extends straight and it is accordingly preferable to set the outer diameter of the grinding ring 327 twice or more the outer diameter of the wafer 10.

As described above, the back side 10*b* of the wafer 10 is ground in the first grinding step in such a manner that the chuck table 52 holding the wafer 10 is rotated and the grinding ring 327 is also rotated at a position where the grinding ring 327 is passed through the center of the wafer 10. By the first grinding step, the thickness of the wafer 10 is reduced to a predetermined thickness, so that the wafer 10 can be ground without reducing a grinding efficiency. Thereafter, the back side 10*b* of the wafer 10 is further ground in the second grinding step in such a manner that a saw mark is not formed in a direction where the die strength of a chip is prone to be reduced in relation to the mark indicating the crystal orientation of the wafer 10. Accordingly, a reduction in die strength of the chip obtained by dividing the wafer 10 can be prevented. Further, in the second grinding step, the upper surface (back side 10*b*) of the outer circumferential portion of the wafer 10 is positioned directly below the locus of rotation of the grinding ring 327 and the grinding ring 327 is lowered to partially grind the back side 10*b* of the wafer 10. Thereafter, the chuck table 52 is moved relatively to the grinding ring 327 in parallel thereto to thereby entirely grind the back side 10*b* of the wafer 10. Thus, the grinding ring 327 is kept in contact with the wafer 10 during the second grinding step, so that the grinding operation can be smoothly performed without giving a shock to the wafer 10.

In the case that each device formed on the front side of the wafer is oblong, the wafer is preferably positioned in the wafer positioning step in such a manner that the saw mark S2 to be formed in the second grinding step extends substantially parallel to the longer sides of each oblong device.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A wafer grinding method for grinding a wafer having a mark for indicating crystal orientation, said wafer grinding method comprising:

a first grinding step for grinding the upper surface of said wafer by rotating a chuck table holding said wafer thereon, rotating a grinding ring, positioning said grinding ring so that said grinding ring is passed through the center of said wafer, and feeding said grinding ring in a direction perpendicular to a holding surface of said chuck table on which said wafer is held;

a wafer positioning step for positioning the upper surface of an outer circumferential portion of said wafer directly below the locus of rotation of said grinding ring after said first grinding step by relatively moving said chuck table and said grinding ring in parallel in a first direction while keep rotating said chuck table and said grinding ring; and a second grinding step for grinding the upper surface of said wafer ground by said first grinding step by first stopping the rotation of said chuck table so that said mark indicating the crystal orientation of said wafer held on said chuck table is pointed in a predetermined direction, next feeding said grinding ring being rotated by a predetermined amount in the direction perpendicular to said holding surface of said chuck table, and next relatively moving said chuck table and said grinding ring in parallel in a second direction opposite to said first direction.

* * * * *